US006945168B1

(12) United States Patent
Niswonger

(10) Patent No.: US 6,945,168 B1
(45) Date of Patent: Sep. 20, 2005

(54) APPARATUS AND METHOD FOR A SILKSCREEN

(76) Inventor: John O. H. Niswonger, 28947 Thousand Oaks BI #212, Agoura Hills, CA (US) 91301

( * ) Notice: Subject to any disclaimer, the term of this patent is extended or adjusted under 35 U.S.C. 154(b) by 0 days.

(21) Appl. No.: 10/834,521

(22) Filed: Apr. 29, 2004

(51) Int. Cl.[7] ..... B41F 15/00; B41L 13/00; B05C 17/06

(52) U.S. Cl. ..... 101/128.1; 101/127; 101/127.1; 101/114

(58) Field of Search ..... 101/128.1, 127, 101/127.1, 114; B41F 15/00; B41L 13/00

(56) References Cited

U.S. PATENT DOCUMENTS 4,452,138 A * 6/1984 Bubley et al. ..... 101/127.1
5,794,528 A * 8/1998 Gronig et al. ..... 101/127.1
5,852,974 A * 12/1998 Egan et al. ..... 101/127.1

* cited by examiner

*Primary Examiner*—Andrew H. Hirshfeld
*Assistant Examiner*—Marvin P. Crenshaw
(74) *Attorney, Agent, or Firm*—Ronald Rohde; C. Bart Sullivan

(57) ABSTRACT

An apparatus and method of making a silkscreen mesh holding apparatus is described. In one embodiment, the apparatus is configured to allow a silkscreen mesh to be adhesively bonded to the apparatus while preventing the formation of residual staining liquids thereon. In one configuration, the apparatus formed of tubular material and is coated with a powder coating configured to allow the apparatus to be easily cleaned with more environmental safe types of cleaning solvents. In one embodiment, the apparatus is coated with a powder coating configured to provide an adhesive attached thereto a bond strength, within a bond strength range, that allows a silkscreen mesh bonded therewith to be removed by peeling such silkscreen mesh and adhesive from the apparatus without the use of solvents.

20 Claims, 4 Drawing Sheets

APPARATUS AND METHOD FOR A SILKSCREEN

BACKGROUND OF THE INVENTION

1. Field of the Invention

Embodiments of the present invention generally relate to silkscreen methods and devices.

2. Description of the Related Art

Generally, silkscreen devices are used to transfer an image to a surface. For example, conventional silkscreen techniques have been developed and used for years as a means to transfer artwork to toys, such as skateboards, or clothing, such as a "t-shirt", for display to the public. Conventionally, a device used to silkscreen images onto surfaces such as cloth includes a frame having a silk screen transfer material mounted thereon. The silkscreen transfer material is generally made up of a mesh material (mesh), conventionally polyester material that allows staining liquids such as ink to be dispensed in a pattern onto the material. The mesh is configured to allow ink, for example, to touch some areas of a surface being silk-screened, such as cloth, while being kept from touching other areas of such surface to form a pattern. Often, multiple silk-screen transfers are made with different meshes so that an image may be created in different colors and patterns, which when overlaid ultimately produce a final image on the material.

Silkscreen mesh materials are often mounted to a frame made of wood or metal. Mounting methods generally include gluing or clamping the mesh to the frame. The mesh is stretched tightly over the frame. Glue may then be applied to the mesh where it engages the frame. When the glue cures, it bonds the mesh to the frame, providing a stable and accurate transfer mechanism. When gluing a mesh to a metal such as aluminum, the glue must be formulated to adhere to the metal. For example, a two-part epoxy or cyanoacrylate (super glues) is often used to bond such mesh to a silkscreen frame. Unfortunately, two-part epoxies require about 15 minutes to form a bond. Super glues, while bonding instantly, require additional time to cure.

Conventionally, during the silkscreen process, the frame as well as the mesh are exposed to several caustic and staining liquids such as ink. Often, the wood, metal, or plastic frame absorbs at least some of such caustic and staining liquids. Once the silkscreen processes is complete the frame may be reclaimed. Unless the silkscreen mesh is needed for further operations, the mesh is removed and discarded and the frame is cleaned to remove such residual staining liquids, residual pieces of mesh, and glues used in the silkscreen process that may contaminate a future silkscreen operation. Generally, to clean such silkscreen process liquids, pieces of mesh, and glues from the frame, the frame is placed in one or more solvent baths and may be sanded, wire brushed, or scraped to remove any contaminants. Unfortunately, such frame reclamation processes are labor intensive and often damage the surface of the frame. While such damage may be minimal, over time it may lead to the destruction of the frame thereby increasing silkscreen production cost. Moreover, such solvent baths are often highly caustic or hazardous liquids, for example gasoline, that may be unhealthy for the silk screen processing personnel exposed thereto, expensive, and if disposed of improperly often lead to environmental contamination.

Therefore, what is needed is a reusable apparatus and method of making such an apparatus that supports a mesh for silk-screening, that is economical, and is configured to reduce the need for excessive labor and environmentally damaging solvents to reclaim apparatus for reuse.

SUMMARY OF THE INVENTION

An embodiment of the present invention is an apparatus configured to hold a silkscreen mesh with at least one adhesive while resisting staining liquids such as ink and environmental elements that cause corrosion. The apparatus includes a frame body formed from sections of tubular material joined at adjacent ends. The frame body is configured to support the silkscreen mesh for silkscreen processing therewith. The apparatus includes a sealing means for sealing an exterior surface of the frame body from an interior surface disposed therein, a patterned surface disposed integral to the exterior surface, and a coating bonded to the patterned surface. The coating is configured to resist absorption of the staining liquids and protect the exterior surface from the environmental elements, and provide an adhesion surface disposed integral the coating. The adhesion surface is configured to provide a bonding surface for the at least one adhesive to bond thereto with a predetermined bonding quality to secure the silkscreen mesh to the adhesion surface.

An embodiment of the present invention provides a method of constructing a silkscreen frame that is configured to mount a silkscreen mesh thereto and resist contamination by silkscreen processing fluids and external environmental elements that cause corrosion. The method includes forming a frame body from a plurality of tubular frame members. The frame body is configured to support the silkscreen mesh thereon. The method includes welding the tubular frame members at adjacent ends to form at least one welded joint, and removing at least a bead portion of at least one of the welded joints to form such welded joint substantially flush with an exterior surface of the frame body. The method further includes processing the exterior surface to form a pattern defining an adhesion surface structure thereon, applying a powder coating of polymer materials to the exterior surface, and curing the powder coating of polymer materials to form an exterior coating on the frame body. The exterior coating is configured to seal the frame body from the silkscreen process fluids and the external environmental elements.

An embodiment of the present invention provides a method for constructing a silkscreen frame that is configured to resist intrusion of silkscreen processing fluids, solvents, and environmental elements that cause corrosion and provide a surface to bond a silkscreen mesh thereto with one or more adhesives. The method includes forming a tubular silkscreen frame from a plurality of tubular members, welding the plurality of tubular members together at adjacent ends to form the tubular silkscreen frame, and processing an exterior surface of the tubular silkscreen frame to form a planner silkscreen attachment surface structure. The method further includes preparing the exterior surface to form an adhesion surface and forming a coating on the exterior surface of the tubular silkscreen frame with at least one polymer coating. The polymer coating is configured to seal the tubular silkscreen frame from the silkscreen processing fluids, protect the tubular silkscreen frame from corrosion by at least some of the environmental elements, and provide an adhesive surface configured to provide a bonding strength of the adhesives within a predetermined range of bonding strength.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the present invention may admit to other equally effective embodiments.

DETAILED DESCRIPTION OF THE PREFERRED EMBODIMENT

In the following description, numerous specific details are set forth to provide a more thorough understanding of the present invention. However, it will be apparent to one of skill in the art that the present invention may be practiced without one or more of these specific details. In other instances, well-known features have not been described in order to avoid obscuring the present invention.

Figure 1:
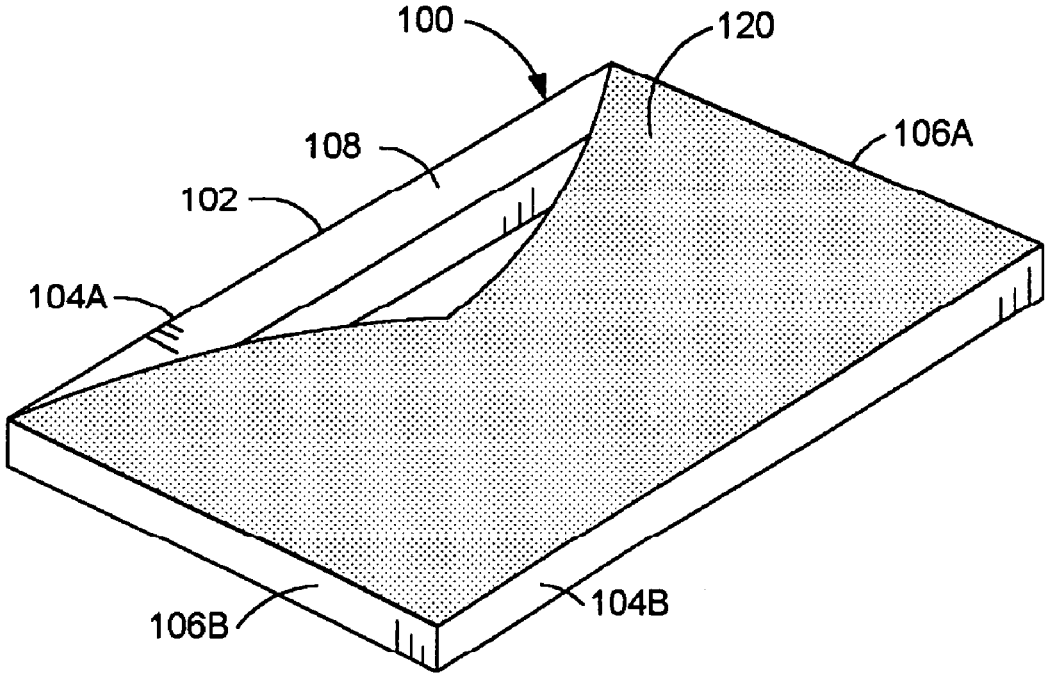
FIG. 1 is a perspective view illustrating one embodiment of a silkscreen apparatus in accordance with aspects of the invention.
Figure 2:
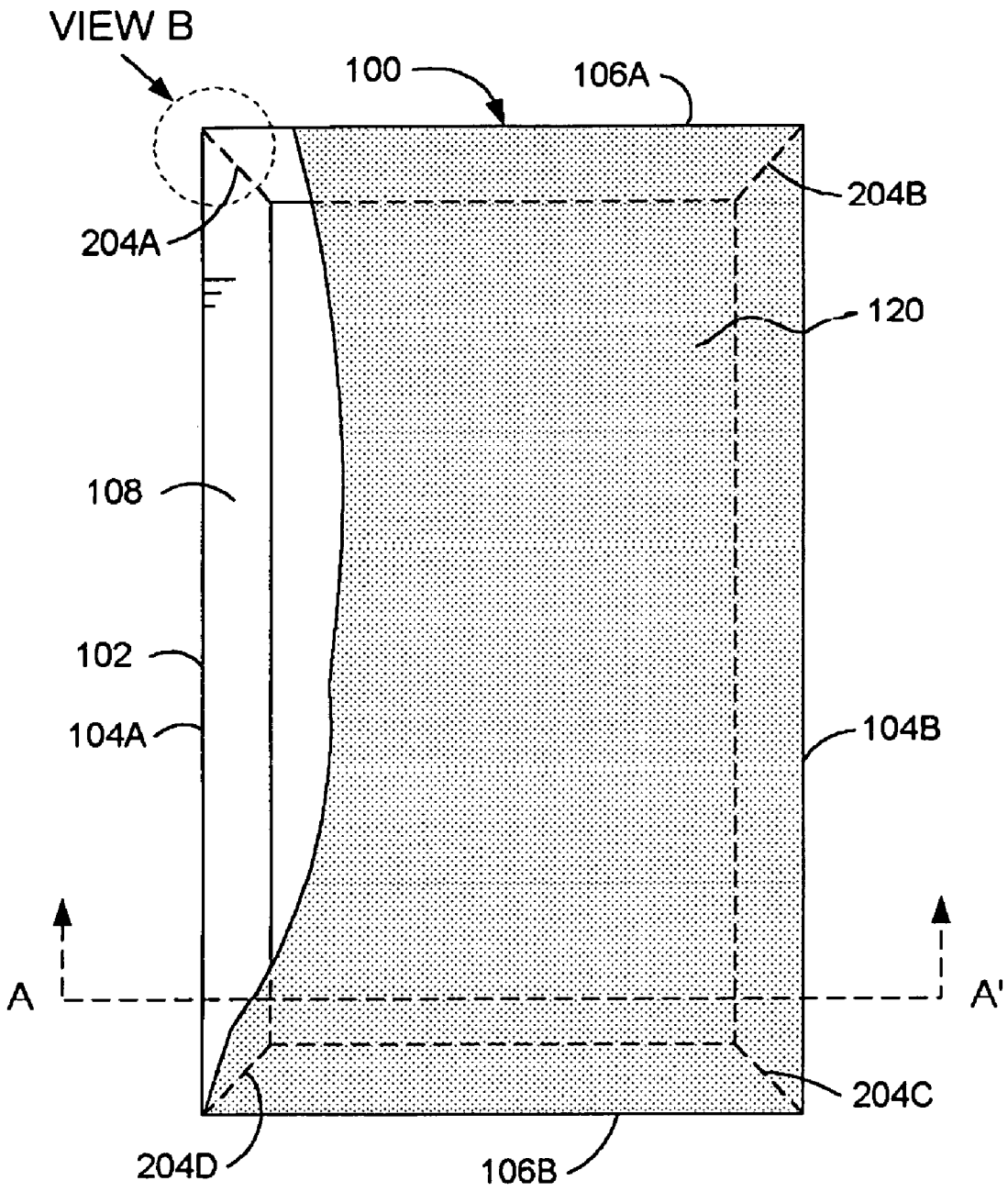
FIG. 2 is a top view illustrating one embodiment of a silkscreen apparatus in accordance with aspects of the invention.

FIG. 1 is a perspective view illustrating one embodiment of a silkscreen apparatus 100 in accordance with aspects of the invention. FIG. 2 is a top view illustrating one embodiment of a silkscreen apparatus 100 in accordance with aspects of the invention. Silkscreen apparatus 100 is configured to support a silkscreen 120 thereon as described further below. In one embodiment, silkscreen frame 100 includes a frame 102. Frame 102 may include a variety of rigid materials that may be used to advantage. For example, frame 102 may include metals such as aluminum, steel, and the like, or include plastic materials configured for such use. Frame 102 includes a side member 104A, another side member 104B, a top member 106A, and a bottom member 106B.

In one embodiment, side member 104A, side member 104B, top member 106A, and bottom member 106B are assembled together to define a shape of frame 102. For example, side member 104A and side member 104B may be longer in length than top member 106A and bottom member 106B such that in combination, 104A, side member 104B, top member 106A, and bottom member 106B define a rectangular shape of frame 102. While frame 102 is illustrated with side member 104A, side member 104B, top member 106A, and bottom member 106B, it is contemplated that frame 102 may be constructed as a complete one-piece structure, or may be formed from a plurality of individual pieces. For clarity, side member 104A, side member 104B, top member 106A and bottom member 106B are illustrated in FIG. 2 joined together by respective ends having mitered ends that are positioned at about forty five degrees that when joined together form joints 204A–D. Joints 204A–D are configured to form corners of frame 102. Such joints 204A–D may be formed from other types of edge configurations to form other types of joints 204A–D such as straight joints, curved joints, interlocking joints, and the like.

Frame 102 includes a silkscreen attachment surface 108 thereon configured to receive bonding adhesives for securing silkscreen 120 thereto as described further below. In one embodiment, silkscreen attachment surface 108 may be integral to a planer upper surface portion of side member 104A, side member 104B, top member 106A, and bottom member 106B such that silkscreen attachment surface 108 extends about an entire surface of frame 102 for attachment of silkscreen 120 thereto. Such a silkscreen attachment surface 108 may form a relatively smooth and flat plane to keep silkscreen 120 about planer and wrinkle free when stretched across such silkscreen attachment surface 108. In another embodiment, silkscreen attachment surface 108 may extend along only a portion of frame 102 and occupy an area less than defined by such planer upper surface portion of side member 104A, side member 104B, top member 106A, and bottom member 106B. Thus, only a portion of planer upper surface of side member 104A, side member 104B, top member 106A, and bottom member 106B define a silkscreen attachment surface 108.

Figure 3:
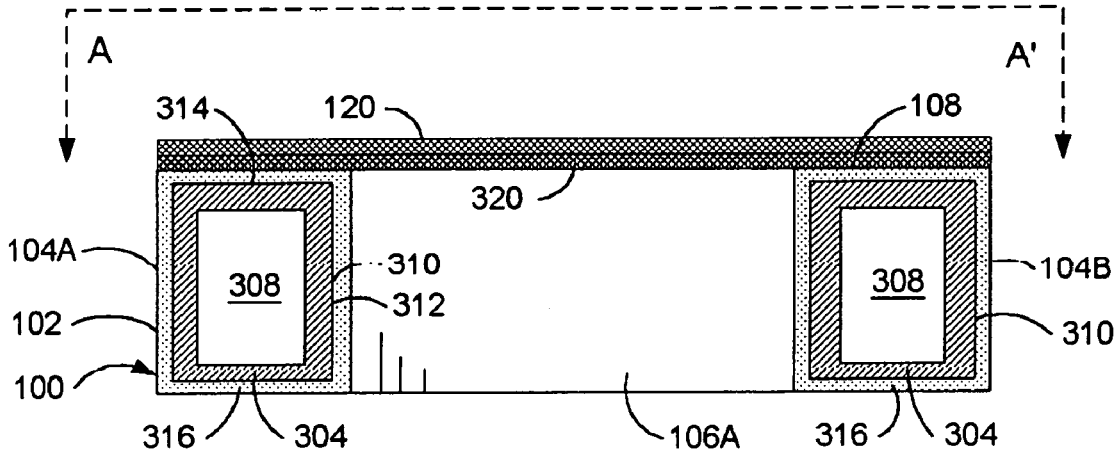
FIG. 3 is a sectional view A–A' illustrating one embodiment of the silkscreen apparatus of FIG. 2 in accordance with aspects of the invention.

FIG. 3 is a sectional view A–A' illustrating one embodiment of the silkscreen apparatus 100 of FIG. 2 in accordance with aspects of the invention. In one embodiment, silkscreen apparatus 100 includes frame 102 formed from a tubular frame member 304. Tubular frame member 304 may be contrasted in virtually an unlimited number of ways. For example, side member 104A, side member 104B, top member 106A, and bottom member 106B may be formed from tubular material that when joined form tubular frame member 304. Tubular frame member 304 may be formed of virtually any tubular material that may be used to advantage such as tubular metal, tubular plastic, and the like. In one configuration, to decrease weight, tubular frame member 304 may be formed from aluminum, sheet metal, or other lightweight material that may be used to advantage.

Tubular frame member 304 may be sized with a predetermined wall thickness to define an inside cavity 308 while providing sufficient rigidity to support a silkscreen 120 stretched thereon. For example, tubular frame 304 may be formed from tubular material having a wall thickness sufficient to support a silkscreen 120 stretched thereon while being configured with a predetermined weight. It is contemplated that tubular frame member 304 may also be formed from one or more honeycomb type materials and other porous materials that provide sufficient rigidity and support for a silkscreen process while providing a weight reduction due to porosity of such materials.

In one embodiment, tubular frame member 304 includes an exterior surface 310 integral thereto. Exterior surface 310 may be configured with a predetermined pattern 312. Pattern 312 may be configured to increase adhesion of a coating 316 thereto. For example, surface 310 may include pattern 312 integral thereon having a dimpled surface, such as an exterior surface of a golf ball, and other types of patterns configured to provide increase surface area and promote an adhesive bond. In one configuration, pattern 312 is formed by sand blasting exterior surface 310. Such a sand blasting process may create a plurality of pits in exterior surface 310 that when combined form pattern 312. Tubular frame member 304 may also include an upper surface portion 314 of exterior surface 310 positioned adjacent silkscreen 120. Upper surface portion 314 is configured to provide a planner base structure for coating 316 disposed thereon. For example, upper surface portion 314 may be formed by grinding exterior surface 310 such that upper surface portion 314 forms a relatively flat planner base structure for coating 316 which when coated thereon forms silkscreen attachment surface 108.

In one configuration, coating 316 is configured as a barrier to protect exterior surface 310 from fluids used in a silk screening process such as inks, dyes, solvents and the like, and to protect tubular frame member 304 from environmental elements that may cause corrosion, i.e. oxidation, such as water and oxygen. Coating 316 may be formed on exterior surface 310 using virtually an unlimited type of coating techniques such as powder coating, deposition, electroplating, painting, and the like. In one configuration, coating 316 may be formed on exterior surface 310 using at least one type of powder coating technique. In one embodiment, coating 316 may be formed from plastic type materials such as polyester and other materials that are configured to resist staining from staining liquids such as ink, repel environmental elements, and resist etching by solvents used to dissolve adhesive 320.

Coating 316 may be configured to provide an adhesion base for bonding a silkscreen 120 to the frame 102 using a variety of adhesives 320. Silkscreen 120 may be bonded to frame 102 by applying one or more adhesives 320 to either coating 316 or to a portion of silkscreen 120 disposed adjacent thereto, or to both. In an assembly operation, silkscreen 120 is stretched over frame 120. Silkscreen 120 may be composed of a mesh structure. Adhesive 320 may be applied directly to silkscreen 120 whereupon, adhesive 320 diffuses through the mesh structure of silkscreen 120 to silkscreen attachment surface 108 of coating 316. Such silkscreen 120 is kept taught while adhesive 320 cures. Once adhesive 320 cures, extra silkscreen 120 material may be removed by cutting such extra silkscreen 120 material from frame 120 using a straight edge, for example. Adhesive 320 may be virtually any type of adhesive 320 that may be used to advantage. In one embodiment, adhesive 320 may be selected from bonding agents, glues, and the like, that are predetermined to be less toxic to humans and the environment. For example, coating 316 may be configured to provide an adhesive surface for water-soluble non-toxic adhesives 320.

In one configuration, coating 316 may be configured to provide a predetermined adhesion quality for adhesive 320 while resisting both staining fluids and other fluids used in silk screening processes. For example, coating 316 may be configured to repel silkscreen process fluids and provide a silkscreen attachment surface 108 with a predetermined adhesive quality. Such predetermined adhesive quality may be configured where removal of silkscreen 120 does not require solvents but rather may be removed by pulling silkscreen 120 and adhesive 320 from the silkscreen attachment surface 108 mechanically, e.g., by hand. Such a predetermined adhesive quality may be configured so that removal of adhesives 320 may be accomplished with little to no damage to silkscreen attachment surface 108.

Figure 4:
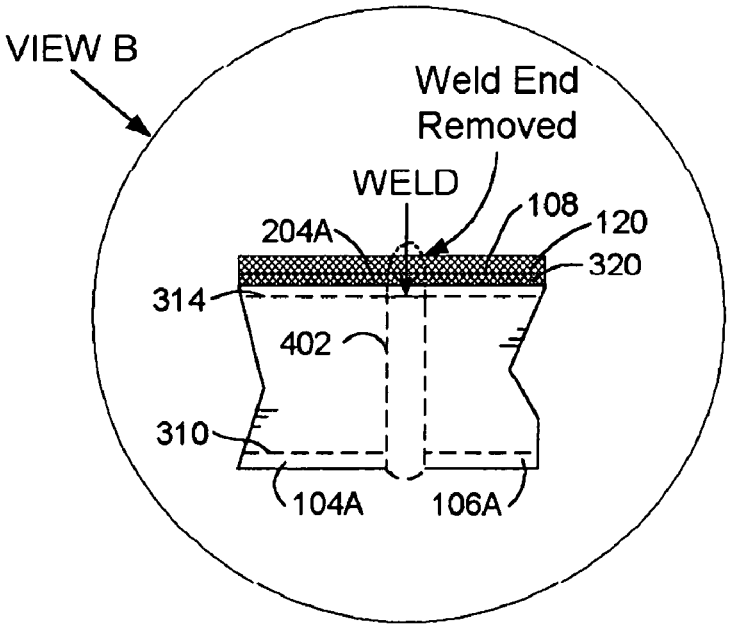
FIG. 4 is an enlarged side view section of the silkscreen apparatus of FIG. 2 in accordance with aspects of the invention.

FIG. 4 is an enlarged side view section of silkscreen apparatus 100 of FIG. 2 in accordance with aspects of the invention. In one embodiment, prior to coating external surfaces of side member 104A, side member 104B, top member 106A, and bottom member 106B as described below, joints 204A–D are formed by welding adjacent ends of side member 104A, side member 104B, top member 106A, and bottom member 106B together. Such a welding process is configured to about seal exterior surfaces 310 of respective joined side member 104A, side member 104B, top member 106A, and bottom member 106B from internal portions of frame 102 as described further herein. For example, a weld 402 is used to join side member 104A with top member 106A. In one configuration, such welding process may leave a bead portion of each joint 204A–D. Such bead portion may be removed such that silkscreen attachment surface 108 is generally flat and planner. For example, weld 402 is processed such that a bead portion of weld 402 extending above silkscreen attachment surface 108 is removed to make weld 402 about flush to surface 314. In one process, such bead portion of weld 402 may be removed by grinding such bead portion of weld 402 as known until about flush with exterior surface 310 of tubular frame member 304.

Figure 5:
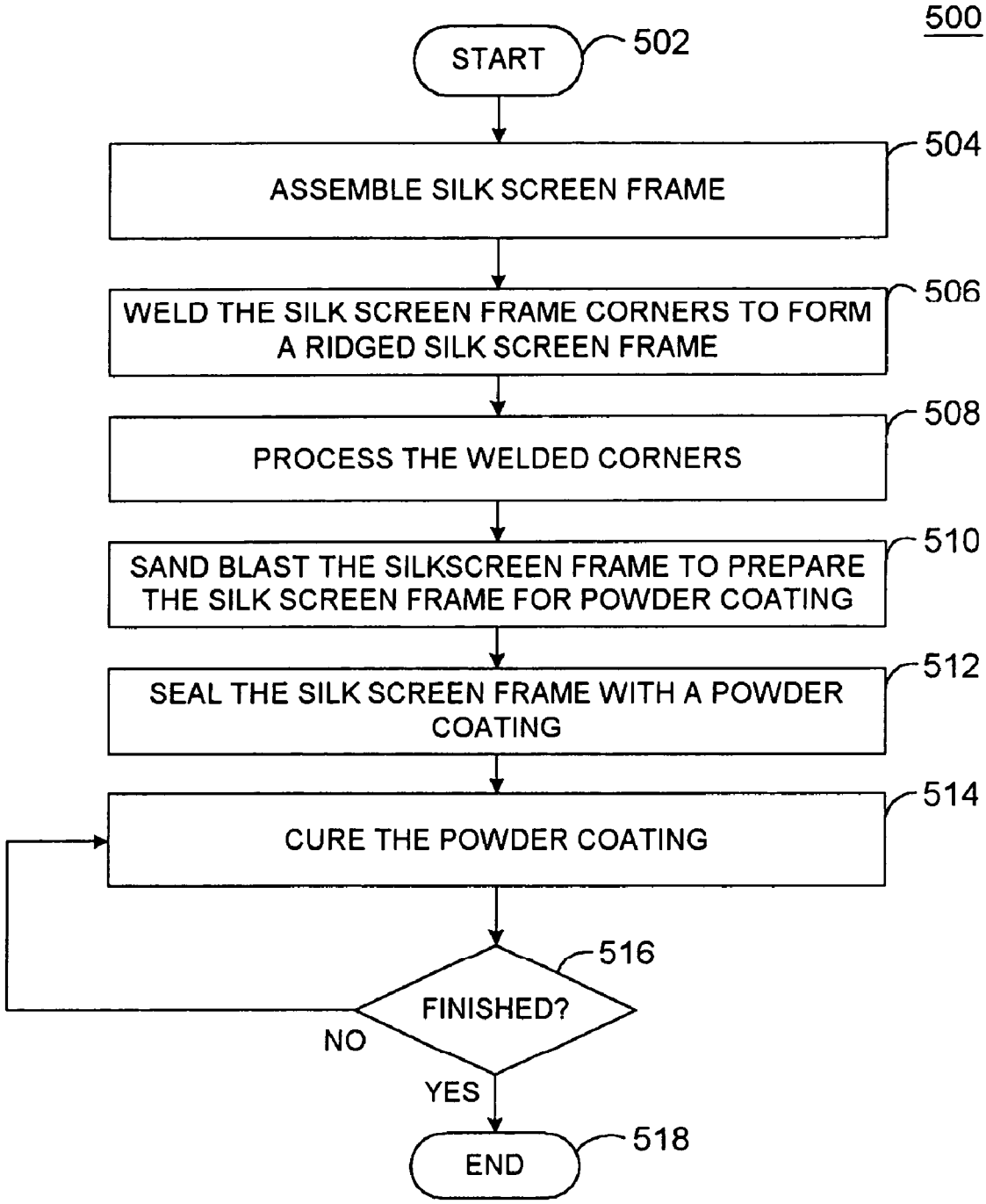
FIG. 5 is a high-level flow diagram of a method of making a silkscreen apparatus in accordance with aspects of the invention.

FIG. 5 is a high-level flow diagram of a method 500 of making a silkscreen apparatus 100 in accordance with aspects of the invention. Method 500 may be entered into, for example, at 502 when a process to form apparatus 100 is initiated by a user, manufacturing process system, and the like. At 504, at least one side member 104A, side member 104B, top member 106A, and bottom member 106B are joined together to form tubular frame member 304. In one embodiment, tubular frame member 304 is assembled by cutting lengths of tubular material, mitering each end of such tubular lengths ends to form joints 204A–D therebetween that when connected define a generally rectangular shape of tubular frame member 304. Such tubular frame member 304 is configured to support a silkscreen 120 stretched thereon.

At 506, side member 104A, side member 104B, top member 106A, and bottom member 106B are welded together using known welding techniques to form a connected tubular frame member 304. In one embodiment, a bead is formed at each joint 204A–D during such a welding process. In one configuration, such a welding process is used to provide a weld 402 that is configured to seal an exterior of tubular frame member 304 from an interior cavity 308 therein. A portion of such bead adjacent a top surface 314 of tubular frame member 304 is removed to make such welded joint 204A–D about flush with top surface 314 at 508. In one process, such a bead portion of weld 402 is removed by grinding such bead portion down until weld 402 is about flush with top surface 314.

At 510, an exterior surface 310 of tubular frame member 304 is processed to form a pattern 312 thereon. Pattern 312 is configured to promote adhesion of a coating 316 disposed thereon. Pattern 312 may be formed using virtually any surface preparation technique configured to modify at least a portion of exterior surface 310 into a pattern 312 used to facilitate adhesion of a coating 316, e.g., increase a surface area of exterior surface 310. In one configuration, such a pattern 312 is formed using a sandblasting technique. For example, sandblasting may be used to form a pattern 312 of surface abrasions, e.g., dimples, scratches, and the like, in surface 310. Thus, such abrasions may modify exterior surface 310 to form pattern 312 having random irregularities that may increase a surface area for coating 316 to adhere thereto.

In one configuration, at 512, coating 316 is formed using at least one powder coating technique but may be applied using other techniques such as painting, electroplating, deposition, and other types of coating application techniques that may be used to advantage. For example, coating 316 may be formed by positioning an electrically grounded tubular frame member 304 into a process position, e.g., hanging. At 512, such tubular frame member 304 is electrically grounded. In operation, such electrical ground should not be in common with a ground for a powder-coating apparatus (not shown). At 512, such a powder-coating apparatus may be used to apply a charged powder coating material to an external surface 310 of such electrically grounded tubular frame member 304. At least some of such powder coating material electrically adheres to such exterior surface 310 of tubular frame member 304.

At 514, such powder coating material that is adhering to such exterior surface 310 of tubular frame member 304 is bonded to such exterior surface 310 by a curing process. Such curing process may be include heating such tubular frame member 304 and powder coating material that is adhering to such exterior surface 310 within a predetermined range of about 275–400 degrees Fahrenheit for a predetermined time. Such curing process at 514 is configured to bond coating 316 to exterior surface 310. While such a curing process of coating 316 is described in terms of being cured at a temperature of about 275–400 degrees Fahrenheit for a predetermined time, other curing techniques are contemplated that provide coating 316. In one configuration, at 514 such coating 316 may be configured to provide a silkscreen process barrier to protect such exterior surface 310 of tubular frame member 304 from staining liquids, e.g., ink, and external environmental elements that cause corrosion, as described further herein. Coating 316 may be formed of powder coating materials and cured at predetermined amount of time and temperature to provide a silkscreen attachment surface 108 configured to bond with a variety of adhesives 320, some of which are described herein, of which some may be removed without solvents by non-invasive mechanical removal, e.g., peeling, from such coating 316. At 516, if coating process is finished, then method 500 proceeds to 518 and ends. If however, such coating process is not finished, e.g., coating 316 is not fully cured, then method 500 returns to 514.

While the foregoing is directed to embodiments of the present invention, other and further embodiments of the invention may be devised without departing from the basic scope thereof, and the scope thereof is determined by the claims that follow.

What is claimed is:

1. An apparatus configured to hold a silkscreen mesh with at least one adhesive while resisting staining liquids such as ink and environmental elements that cause corrosion, the apparatus comprising a silkscreen mesh:

a frame body formed of sections of tubular material joined at adjacent ends, the frame body configured to support said silkscreen mesh for silkscreen processing therewith;

a sealing means for sealing an exterior surface of the frame body from an interior surface disposed therein;

a patterned surface disposed integral to the exterior surface;

a coating bonded to the patterned surface, the coating configured to resist absorption of the staining liquids and protect the exterior surface from the environmental elements, and an adhesion surface disposed integral the coating, the adhesion surface configured to provide a bonding surface for the at least one adhesive to bond thereto with a predetermined bonding quality to secure said silkscreen mesh to the adhesion surface.

2. The apparatus of claim 1, wherein the adjacent ends are joined together to form joints.

3. The apparatus claim 2, wherein the joints are welded together to seal the exterior surface of the frame body from the interior surface disposed therein.

4. The apparatus of claim 1, wherein the sealing means is a weld.

5. The apparatus of claim 1, wherein the patterned surface is formed of a plurality of pits.

6. A method of constructing a silkscreen frame that is configured to mount a silkscreen mesh thereto and resist contamination by silkscreen processing fluids and external environmental elements that cause corrosion, the method comprising:

forming a frame body from a plurality of tubular frame members, the frame body supporting said silkscreen mesh thereon;

welding the tubular frame members at adjacent ends to form at least one welded joint;

removing at least a bead portion of at least one of the welded joints to form such welded joint substantially flush with an exterior surface of the frame body;

processing the exterior surface to form a pattern defining an adhesion surface structure thereon;

applying a powder coating of polymer materials to the exterior surface; and curing the powder coating of polymer materials to form an exterior coating on the frame body, the exterior coating configured to seal the frame body from the silkscreen process fluids and the external environmental elements.

7. The method of claim 6, wherein forming a frame body from a plurality of tubular frame members comprises cutting lengths of tubular material to form the tubular frame members.

8. The method of claim 6, wherein forming a frame body from a plurality of tubular frame members comprises mitering the adjacent ends of the tubular frame members to form the joints.

9. The method of claim 6, wherein the welding the tubular frame members comprises welding the joints sufficiently to seal the exterior surface from an interior surface of the frame body.

10. The method of claim 6, wherein the removing at least a bead portion of at least one of the welded joints to form such welded joint substantially flush with an exterior surface of the frame body comprises grinding the bead portion about flush with a segment of the exterior surface disposed adjacent to a silkscreen mounting surface.

11. The method of claim 6, wherein the processing the exterior surface comprises sandblasting the exterior surface to form the pattern thereon.

12. The method of claim 6, wherein the coating is configured to resist the intrusion of the silkscreen processing fluids and the external elements that cause corrosion to the frame body.

13. The method of claim 6, wherein the curing the powder coating comprises heating the powder coating.

14. The method of claim 13, wherein the heating comprises heating the powder coating to about a range of 275–400 degrees Fahrenheit for a predetermined time.

15. A method for constructing a silkscreen frame that is configured to resist intrusion of silkscreen processing fluids, solvents, and environmental elements that cause corrosion and provide a surface to bond a silkscreen mesh thereto with one or more adhesives, the method comprising:

forming a tubular silkscreen frame from a plurality of tubular members, the silkscreen frame supporting said silkscreen mesh thereon;

welding the plurality of tubular members together at adjacent ends to form the tubular silkscreen frame;

processing an exterior surface of the tubular silkscreen frame to form a planner silkscreen attachment surface structure;

preparing the exterior surface to form an adhesion surface; and forming a coating on the exterior surface of the tubular silkscreen frame with at least one polymer coating, the polymer coating configured to seal the tubular silkscreen frame from the silkscreen processing fluids, protect the tubular silkscreen frame from corrosion by at least some of the environmental elements, and provide an adhesive surface configured to provide a bonding strength of the adhesives within a predetermined range of bonding strength.

16. The method of claim 15, wherein the welding the plurality of tubular members comprises sealing at least one gap in the tubular silkscreen frame by welding the at least one gap sufficiently to seal the at least one gap.

17. The method of claim 15, wherein the processing an exterior surface of the tubular silkscreen frame to form the planner silkscreen attachment surface structure comprises grinding at least one weld about flush with the planner silkscreen attachment surface structure.

18. The method of claim 15, wherein coating the exterior surface of the tubular silkscreen frame comprises heating the frame and coating to about 275–400 degrees Fahrenheit for a predetermined time sufficient to form the coating.

19. The method of claim 15, wherein the coating comprises polyester.

20. The method of claim 15, wherein the coating comprises an adhesive quality that provides a bonding strength with the one or more adhesives such that at least some of the one or more adhesives may be removed from the coating by a stripping force within a predetermined stripping force range without the intervention of solvents.

* * * * *